United States Patent [19]

Corman

[11] Patent Number: 4,714,441

[45] Date of Patent: Dec. 22, 1987

[54] ELECTRICAL SOCKET

[75] Inventor: Ned E. Corman, Harrisburg, Pa.

[73] Assignee: AMP Incorporated, Harrisburg, Pa.

[21] Appl. No.: 8,679

[22] Filed: Jan. 29, 1987

[51] Int. Cl.[4] ..... H01R 13/11

[52] U.S. Cl. ..... 439/842

[58] Field of Search ..... 439/834, 842, 843, 852, 439/856

[56] References Cited

U.S. PATENT DOCUMENTS

| | | | |
|---|---|---|---|
| 3,614,717 | 10/1971 | Boersma | 439/843 |
| 3,317,887 | 5/1967 | Henschen et al. . | |
| 3,470,527 | 9/1969 | Bonhomme . | |
| 3,605,078 | 9/1971 | Paullus . | |
| 3,614,717 | 10/1971 | Boersma | 439/843 |
| 4,550,972 | 11/1985 | Romak . | |

FOREIGN PATENT DOCUMENTS 544420 4/1974 Switzerland .

*Primary Examiner*—Joseph H. McGlynn
*Attorney, Agent, or Firm*—Allan B. Osborne

[57] ABSTRACT

An electrical socket having a plurality of contact elements with bowed beams on each end cooperating to form resilient passages to receive a pin. The contact elments are supported on a disc with the beams being on each side thereof. A cavity in the housing receives the disc and associated contact elements. An opening through the disc is sized so that the pin passing therethrough cannot wobble and overstress the beams.

10 Claims, 7 Drawing Figures

ELECTRICAL SOCKET

FIELD OF THE INVENTION

The present invention relates to a pin receiving, electrical socket having a plurality of independent resilient contact elements.

BACKGROUND OF THE INVENTION

Sockets having a biasing device to provide normal forces against an inserted pin are well known in the art. Such devices include longitudinally extending leaf springs disclosed in U.S. Pat. No. 3,317,887, contact arms surrounded by a cylindrical spring disclosed in U.S. Pat. No. 3,605,078 and a socket formed from a plurality of wires extending obliquely to the longitudinal axis disclosed in U.S. Pat. No. 3,470,527.

It is now proposed to provide a socket formed from a plurality of double looped contact elements positioned circumferentially to define a pin receiving opening.

SUMMARY OF THE INVENTION

According to the present invention, an electrical socket is provided having a plurality of elongated contact elements with curved or bowed beams on each end of an interconnecting strap. The contact elements are on a disc with the beams on each side thereof cooperating with adjacent beams to form two, independent acting, resilient passages which receive an elongated pin for electrical engagement therewith. The two passages permit a reduction in the force required for inserting the pin into the socket without reducing the normal force acting on the pin.

DESCRIPTION OF THE INVENTION

Figure 1:
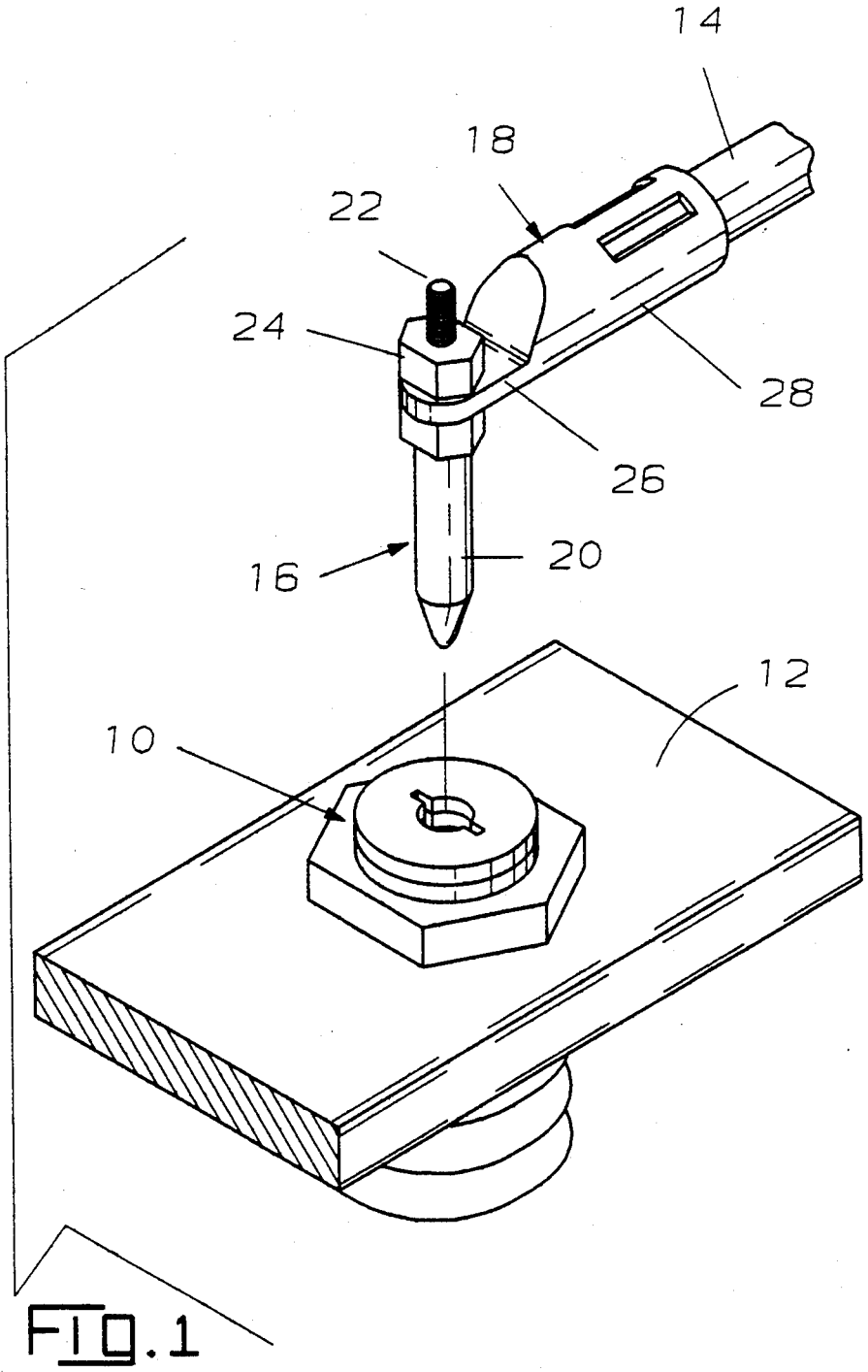
FIG. 1 is a perspective view of a high current socket constructed in accordance with the present invention.

Electrical socket 10 of the present inention is shown in FIG. 1 attached to bus bar 12 for transmitting current to or from electrical wire 14 through pin 16 and terminal 18. Socket 10 may be mounted on bus bar 12 by any conventional method such as being threadly received therein as shown. Pin 16 is a conventional, complemental member to sockets such as socket 10. Pin 16 includes contact shaft 20 having a bullet shaped free end and threaded post 22 for being attached to ring tongue terminal 18 by means of nut 24. Terminal 18 is also a conventional electrical item and includes tongue 26 with an opening (not shown) for receiving post 22 or the like. Terminal 18 also includes wire barrel 28 which is crimped around a bared end (not shown) of wire 14.

Figure 2:
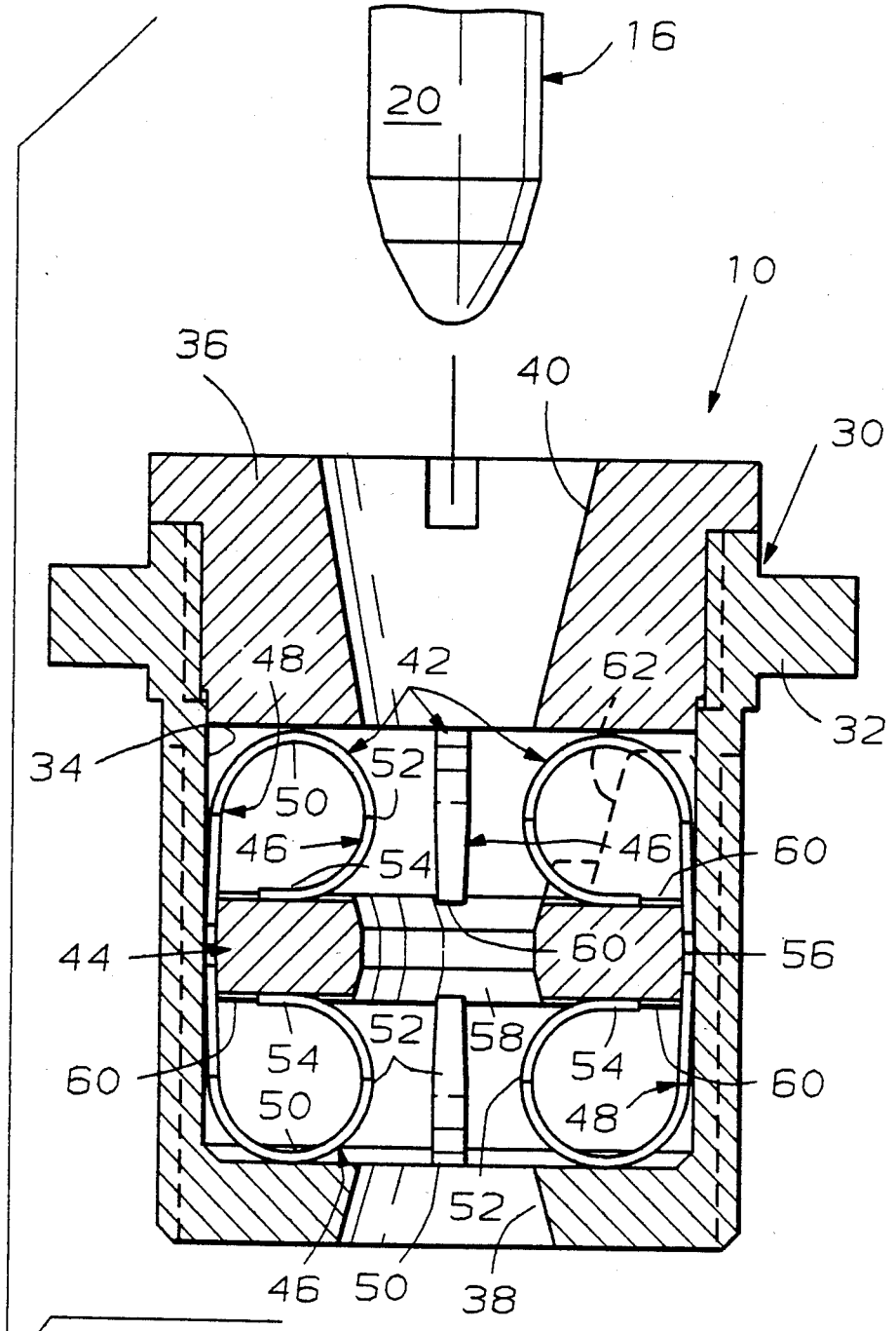
FIG. 2 is a side cross-sectional view of the socket.

As shown in FIG. 2, socket 10 includes cup-shaped housing 30 with an external, circumferential flange 32 at one end and threaded at another end. Cavity 34 of housing 30 is threaded at one end to receive cap 36. In the alternative, housing 30 and cap 36 could be made so that cap 36 would be pressed into the opening to cavity 34. Passages 38 and 40 are provided in housing 30 and cap 36 respectively to provide access to cavity 34 from both ends of socket 10. Both passages 38, 40 are tapered towards cavity 34 with the smallest diameter thereof just accommodating contact shaft 20 of pin 16. Housing 30 and cap 36 are made from brass, although other suitable conductive materials may be used.

Figure 3:
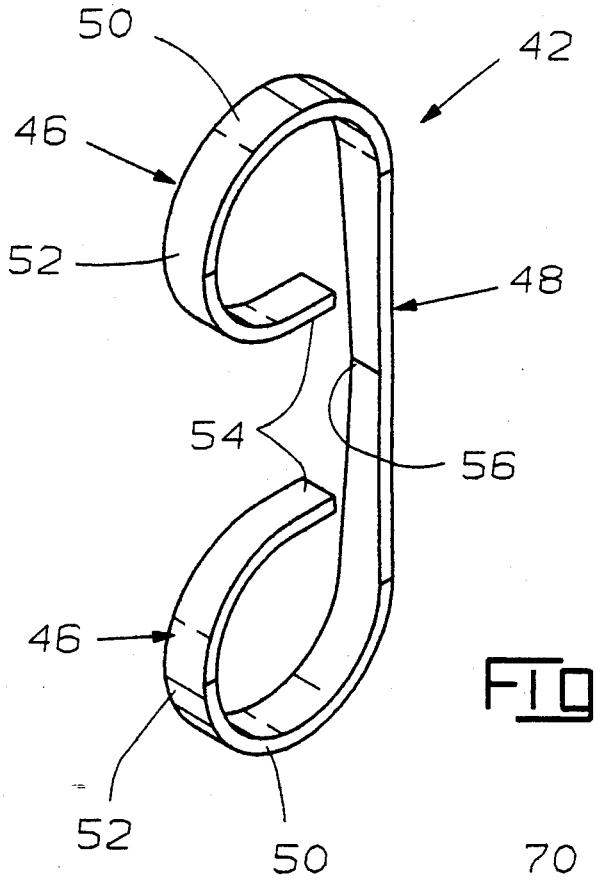
FIG. 3 is a perspective view of a contact element of the socket.

A plurality of contact elements 42, mounted on disc 44, are positioned in cavity 34 of housing 30. As shown in both FIGS. 2 and 3, elements 42 include two curved or generally circular contact beams 46 with one being at each end of an intermediate or connecting strap 48. Beams 46 incorporate spring portions 50, contact area 52 and free end portions 54 pointing in towards strap 48. As can be seen, end portion 54 is narrower in width relative to the rest of beam 46.

Strap 48 is bent at the mid-point as indicated by reference numeral 56 to preload beams 46 towards each other. Further, strap 46 thins in width to mid-point 56 so that its resiliency is greater than beams 46.

Preferably, elements 42 are stamped and formed from a copper-iron alloy and plated with gold or silver over nickel at contact area 52.

Disc 44 is made from brass or plastic with center opening 58 therethrough having a diameter such that contact shaft 20 of ppin 16 is received therethrough with very little play. A plurality of grooves 60 are provided on both surfaces of disc 44, extending from center opening 58 out to the edge with the grooves on one surface being in line with those on the opposite surface. The thickness of disc 44 between opposing grooves 60 is slightly greater than the space between free end portions 54 on a contact element 42.

Disc 44 can incorporate outwardly projecting walls on both surfaces as shown in phantom in FIG. 2 and indicated by reference numeral 62. Walls 62 would be located between grooves 60 and would support beams 46 vertically. This embodiment would preferrably be molded from a suitable plastic material.

As shown in FIG. 2, contact elements 42 are positioned around cavity 34 with disc 44 in the space between free end portions 54 which are slidingly received in grooves 60. Contact areas 52 on beams 46 face inwardly over center opening 58 in disc 44 and define two resilient, pin-receiving passages 64 with one passage 64 being on each side of disc 44. As will be discussed below, the sets of beams 46 constituting passages 64 act independently from each other not withstanding their physcial connection. Connecting straps 48 are pressed against the walls of cavity 34 to make electrical contact with housing 30.

Figure 4:
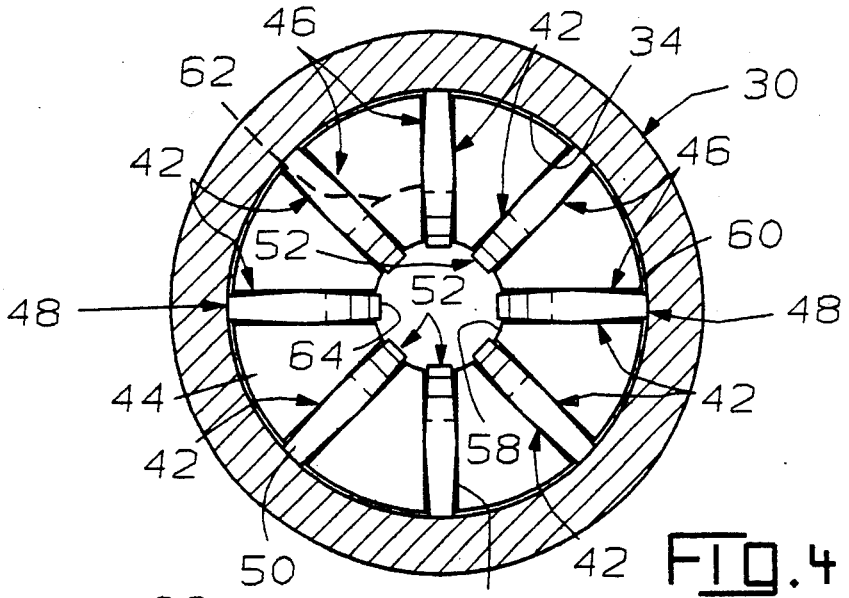
FIG. 4 is an end cross-sectional view of the socket.

FIG. 4 is a view looking into cavity 34 showing the smaller size of passages 64 relative to center opening 58 of disc 44.

Figure 5:
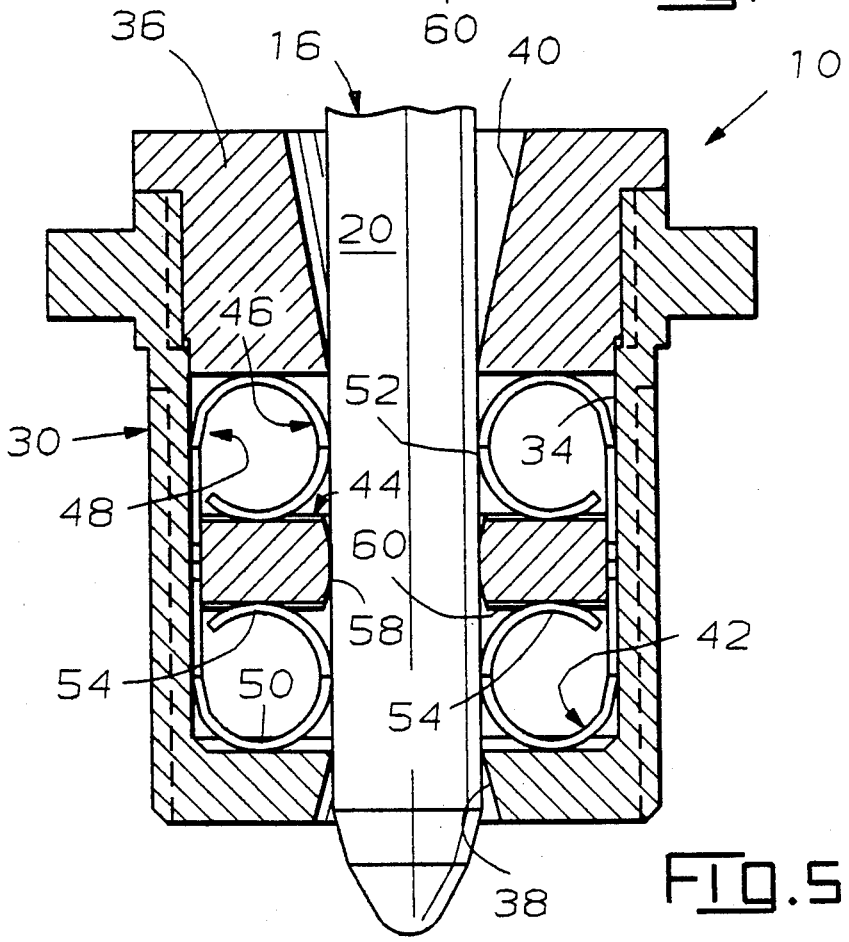
FIG. 5 is the cross-sectional view of FIG. 2 with a pin inserted into the socket.

FIG. 5 shows contact shaft 20 of pin 16 inserted into passages 64 defined by contact elements 42 and opening 58 through disc 44. As shaft 20 enters the first passage 64 and engages beams 46 in the set defining that passage, the portion of straps 48 extending from midpoint 56 to spring portion 50 of those beams 46 are resiliently forced against the cavity wall. Thereafter, the stiffer beams 46 are resiliently compressed into a smaller diameter with the hinge point being at spring portions 50. Free end portions 54 slide outwardly in grooves 60 in disc 44 towards respective straps 48 to accommodate the resilient deformation.

Passing from the first passage 64 and through opening 58 in disc 44, shaft 20 enters the second passage 64 and engages beams 46 in the set defining that passage. A repeat of the events which occurred in the first passage 64 takes place; i.e., the portion of straps 48 associated with the second set are resiliently forced against the cavity wall and beams 46 are resiliently compressed with free end portions 54 sliding along grooves 60 in response thereto.

As is apparent from the foregoing, an advantage gained from having independently acting, dual beam sets is that the insertion force is broken into two main events of lesser magnitude without a loss in normal forces beams 46 exert against shaft 20. Further, each beam set provides a variable spring rate which subdivides each main event into two smaller events. Thus, a high normal force is obtained with insertion force peaks remaining acceptable.

As noted above, passages 38, 40 in housing 30 and cap 36 respectively, and center opening 58 in disc 44 is sized to first receive contact shaft 20. Accordingly, beams 46 cannot be overstressed by oversized pins. Further, pin 16 cannot be wobbled in socket 10 which also could cause beam overstress.

Figure 6:
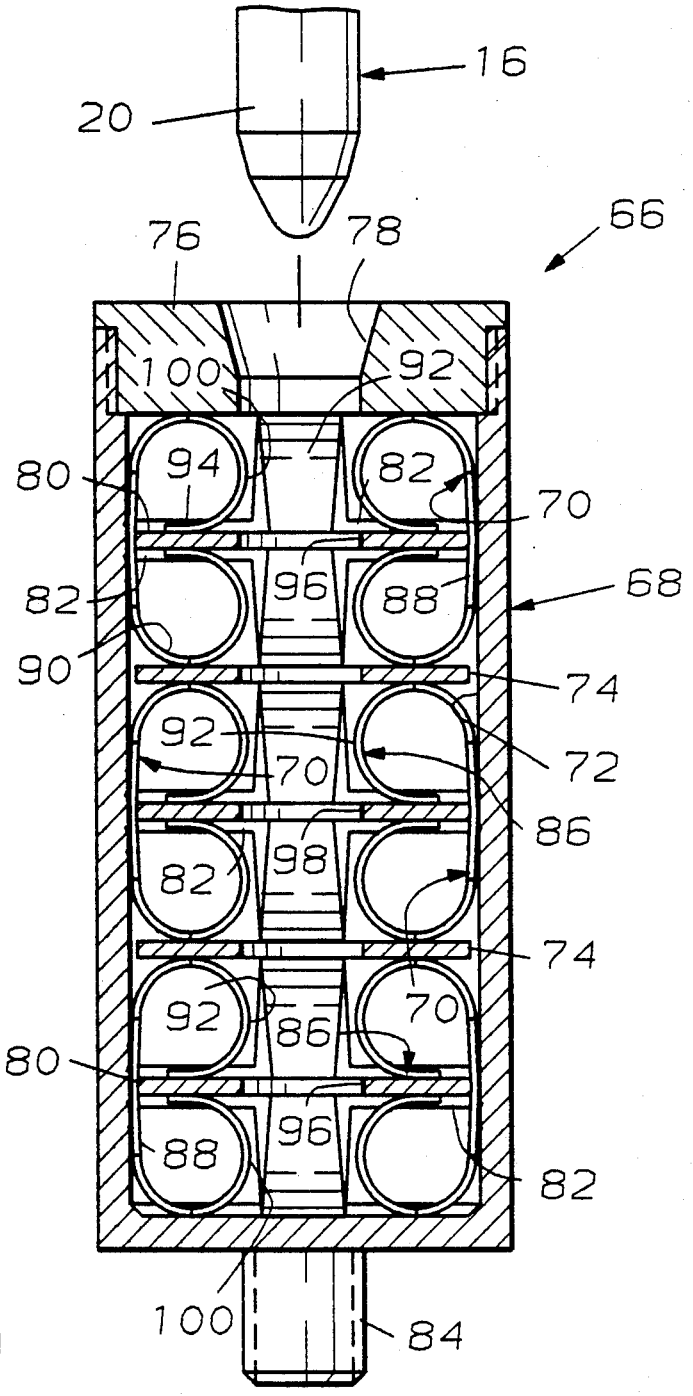
FIG. 6 is a side cross-sectional view of another embodiment of the socket.
Figure 7:
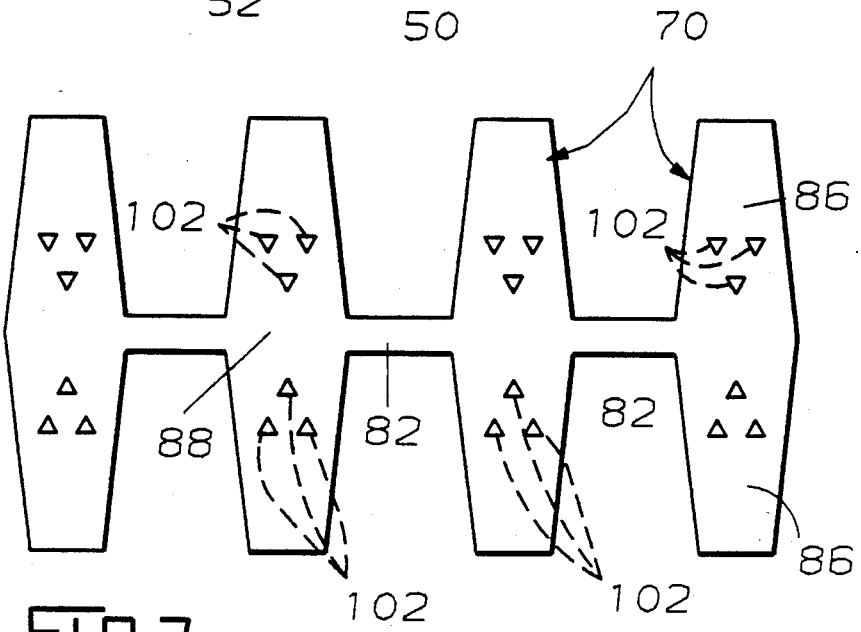
FIG. 7 is a plan view of an alternative contact element.

Another embodiment of the present invention is shown in FIGS. 6 and 7. Socket 66 includes housinng 68, and three sets of contact elements 70 stacked in cavity 72 with spacers 74 between each set. Further included is cap 76 having opening 78 therethrough and which is threadedly received or pressed in one end of housing 68. As with socket 10, each set of contact elements 70 are arranged around a disc 80. Further, each element 70 in a given set is interconnected by connecting links 82. Links 82 are also shown in FIG. 7, which is a view showing a strip of stamped elements 70 prior to being formed. A suitable material copper-iron alloy.

Housing 68 is provided with a threaded post 84 at one end for mounting on a bus bar (not shown) or the like.

Elements 70 are wider than elements 42 but are structurally alike, having beams 86 and connecting straps 88. Each beam 86 includes spring portion 90, contact areas 92 and free end poritions 94. Discs 80 are thinner than counterpart disc 40. Both discs 80 and spacers 74 include openings 96, 98 respectively and are preferably made from brass.

As with socket 10, beams 86 of elements 70 define passages 100 which resiliently receive shaft 20 of pin 16.

A further embodiment of contact elements 70 is indicated in phantom in FIG. 7. Lances 102 may be struck in connecting straps 88 so that upon positioning elements 70 in housing cavity 72, the walls thereof would be scrapped by lances 102 to enhance electrical contact.

As can be discerned, an electrical socket for receiving electrical pins has been disclosed. The socket includes a housing in which a plurality of contact elements are positioned. Curved beams at each end of the elements cooperate to form resilient passages into which the shaft is inserted for electrical contact therewith. A disc on which the contact elements are mounted in an annular fashion includes an opening through which the shaft passes with very little play to prevent overstressing the beams.

I claim:

1. An electrical socket for receiving a pin, comprising housing means defining cavity means, first disc means disposed in said cavity means and having an opening therethrough; and a plurality of contact means, each having a resilient, curved beam means on each end of a connecting strap means, said contact means positioned on and around said first disc means with said beam means on each contact means being on each side thereof, said beam means cooperating with adjacent beam means to define passages on each side of said disc means to resiliently receive the pin for electrical engagement therewith.

2. The electrical socket of claim 1 further including cap means for closing said cavity means in said housing means, said cap means having an opening through which the pin may pass.

3. The electrical socket of claim 1 wherein said contact means are connected to each other by connecting link means.

4. The electrical socket of claim 1 wherein the opening in said disc has a diameter just sufficient to admit the pin therethrough.

5. The electrical socket of claim 1 wherein said beam means on one side of said first disc means act independently relative to said beam means on another side of said first disc means during insertion of the pin.

6. The electrical socket of claim 1 wherein said two beam means on said contact means are formed around with free ends thereon projecting back in towards said strap means, said free ends being generally parallel with and spaced from each other.

7. The electrical socket of claim 6 wherein said free ends slidingly engage said first disc means on which said contact means are positioned.

8. The electrical socket of claim 7 wherein said strap means on said contact means is bent so that said beam means on each end thereof are displaced towards each other.

9. The electrical socket of claim 1 further including a second disc means with a plurality of contact means positioned thereon, said second disc means and associated contact means being positioned in said cavity means in tandem with said first disc means and said contact means associated therewith.

10. The electrical socket of claim 9 further including spacer means between contact means positioned on respective first and second disc means.

* * * * *